US006058663A

United States Patent [19]

MacKarvich

[11] Patent Number: 6,058,663

[45] Date of Patent: May 9, 2000

[54] LONGITUDINAL STABILIZER FOR A PREMANUFACTURED BUILDING

[76] Inventor: Charles J. MacKarvich, 1720 Tyler Green Trail, Smyrna, Ga. 30080

[21] Appl. No.: 09/123,806

[22] Filed: Jul. 27, 1998

Related U.S. Application Data

[63] Continuation-in-part of application No. 08/739,717, Oct. 29, 1996, Pat. No. 5,850,718, which is a continuation-in-part of application No. 08/644,069, May 9, 1996, Pat. No. 5,784,844, which is a continuation-in-part of application No. 08/629,834, Apr. 10, 1996, Pat. No. 5,697,191.

[51] Int. Cl.[7] ..... E02D 27/00

[52] U.S. Cl. ..... 52/167.3; 52/292; 52/299; 52/695; 52/DIG. 11

[58] Field of Search ..... 52/146, 167.3, 52/292, 299, 695, 741.1, DIG. 11

[56] References Cited

U.S. PATENT DOCUMENTS

| | | | |
|---|---|---|---|
| 3,747,288 | 7/1973 | Grimelii . | |
| 3,750,349 | 8/1973 | Deike . | |
| 3,751,866 | 8/1973 | Renchen . | |
| 3,802,138 | 4/1974 | McCarter | 52/DIG. 11 |
| 3,830,024 | 8/1974 | Warnke . | |
| 3,845,597 | 11/1974 | Foster . | |
| 4,037,835 | 7/1977 | Forsyth | 52/292 X |
| 4,261,149 | 4/1981 | Gustafson . | |
| 4,348,843 | 9/1982 | Cairns et al. | 52/299 X |
| 4,417,426 | 11/1983 | Meng | 52/126.7 |
| 4,882,887 | 11/1989 | Giles et al. | 52/126.6 |
| 5,359,821 | 11/1994 | Merriam | 52/169.9 |

OTHER PUBLICATIONS

"Manufactured Housing Anchoring Installation"; provided by Tie Down Engineering; pamphlet, 5 pages.

"Ironroot Earth Anchors"; provided by Tie Down Engineering, pamphlet, 3 pages.

"Manufactured Housing Institute Memorandum—NIST Study on Manufactured Home Anchoring Systems"; Frank Walter, P.E., Jan. 10, 1995; 55 pages.

"Laboratory Testing of Soil Anchors For U.S. Dept. of Housing and Urban Development Washington, D.C."; Hud User's Document Production Service, 47 pages.

"NISTIR 5664 Recommended Performance–Based Criteria for the Design of Manufactured Home Foundation Systems to Resist Wind and Seismic Loads"; Richard D. Marshall and Felix Y. Yokel; Aug. 1995; 69 pages.

*Primary Examiner*—Richard Chilcot

*Attorney, Agent, or Firm*—Thomas, Kayden, Horstemeyer & Risley

[57] ABSTRACT

A longitudinal stabilizing system for a premanufactured building having support joists extending along the length of the underside of the building and being supported above the ground by upright piers. The system comprises at least one foundation plate, a joist connector, a plate connector, and a rectilinear strut. The foundation plate is placed between the pier and the ground. The joist connector attaches to the joist of the building. Plate clamps may be used in conjunction with the joist connector to grasp the joist. The plate connector attaches to the foundation plate. The strut is attached to the joist connector at one end and the plate connector at the other end such that the strut slopes downward from the joist towards the ground. In high winds, the weight of the building and the weight of the pier resting on the foundation plate retard lateral movement of the foundation plate and the end of the strut attached to the plate connector, while the end of the strut attached to the joist connector resists movement of the joist along its length.

17 Claims, 7 Drawing Sheets

LONGITUDINAL STABILIZER FOR A PREMANUFACTURED BUILDING

This is a continuation-in-part of U.S. patent application 08/739,717, filed Oct. 29, 1996, now U.S. Pat. No. 5,850,718, which is a continuation-in-part of 08/644,069, filed May 9, 1996, now U.S. Pat. No. 5,784,844 which is a continuation-in-part of U.S. patent application 08/629,834, filed Apr. 10, 1996, now U.S. Pat. No. 5,697,191.

FIELD OF THE INVENTION

This invention relates to a longitudinal stabilizing system for a premanufactred building having support joists extending along the length of the underside of the building and being supported by upright piers. More specifically, this invention relates to a longitudinal wind resistance system where one portion of the system is attached to a support joist of the building, the other portion is placed under the pier supporting the joist, and the two portions are connected by a strut in order to inhibit movement of the building along its length in relation to the piers during exposure to longitudinal winds.

BACKGROUND OF THE INVENTION

Premanufactured buildings, such as mobile homes, trailers, prefabricated houses, and the like are manufactured at a central manufacturing site, and upon completion the buildings are moved to a location where they are to be permanently located and occupied. Because these buildings are designed to be easily moved from the manufacturing site to the permanent location, they are not originally built on a permanent foundation at the manufacturing site, but on a pair of parallel I-beam joists, and then the manufactured building is transported to and mounted upon piers, such as concrete blocks, pilings or stabilizing jacks, at a site where the building will be used. It is important that the building also be anchored in position on the piers, so as to avoid the building being shifted off of its piers by strong winds or earth tremors. A building inadvertently shifted off of its piers can cause serious damage to the building and also can cause human injury.

Various types of stabilizing devices have been used to stabilize the manufactured buildings, to keep the buildings from moving in response to wind forces and earth movement, such as guy wires, straps or other ties which connect the building to anchors or ground fixtures. A traditional approach to providing lateral wind protection for manufactured buildings consists of an anchor having a shaft with one or more helical plates at the bottom of the shaft which can be rotated to move into the earth, and cold-rolled steel strapping installed as diagonal ties between the upper exposed portion of the anchor and the lower main frame of the manufactured building. A system of this type is taught in U.S. Pat. No. 3,747,288. In addition, vertical or "over-the-top" ties may be installed in case of single-wide structures.

The vertical support for manufactured buildings usually is provided by piers, such as concrete masonry piers, prefabricated steel piers, or precast concrete jack stands located under the parallel joists of the main frame of the manufactured building, with the vertical supports being spaced longitudinally along the parallel joists at approximately 8' from one another.

While much attention has been placed on protecting the building from movement due to lateral wind forces, little effort has been placed on protecting the building from movement due to longitudinal wind forces. However, these longitudinal wind forces must be accounted for in order to prevent the building from shifting off the piers during periods of high wind exposure.

Therefore, there is a need to provide a system which protects a manufactured building from horizontal movement along its length relative to the support piers due to longitudinal wind forces.

SUMMARY OF THE INVENTION

Briefly described, the present invention comprises a longitudinal stabilizing system for a premanufactured building having support joists extending along the length of the underside of the building and being supported above the ground by upright piers. The system is utilized to retard movement of the building along its length in relation to the piers during exposure to longitudinal winds. The system includes at least one foundation plate, a joist connector, a plate connector, and a strut. More specifically, the foundation plate supports a pier above the ground, the joist connector attaches to the support joist beneath the building, the plate connector attaches to the foundation plate, and the strut is connected to both the joist connector and the plate connector such that it is sloped downward from the joist towards the foundation plate.

The foundation plate includes a plurality of cleats that engage with the ground. An advantage of the invention is that the plates may be constructed having cleats on all four sides such that the system can be used in conjunction with a lateral wind resistance system.

The system may be used as described or in a double configuration by adding a second joist connector, plate connector, and strut on the opposite side of the pier. Use of a single system protects the building against wind loads. Use of a double system provides added resistance to withstand seismic activities.

Thus, it is an object of this invention to provide a system for a premanufactured building having support joists extending along the length of the underside of the building and being supported by upright piers to retard vertical and horizontal shifting of the building during exposure to longitudinal winds.

Further objects, features, and advantages of the present invention will become apparent upon reading the following specifications, when taken in conjunction with the accompanying drawings.

DETAILED DESCRIPTION

Figure 1:
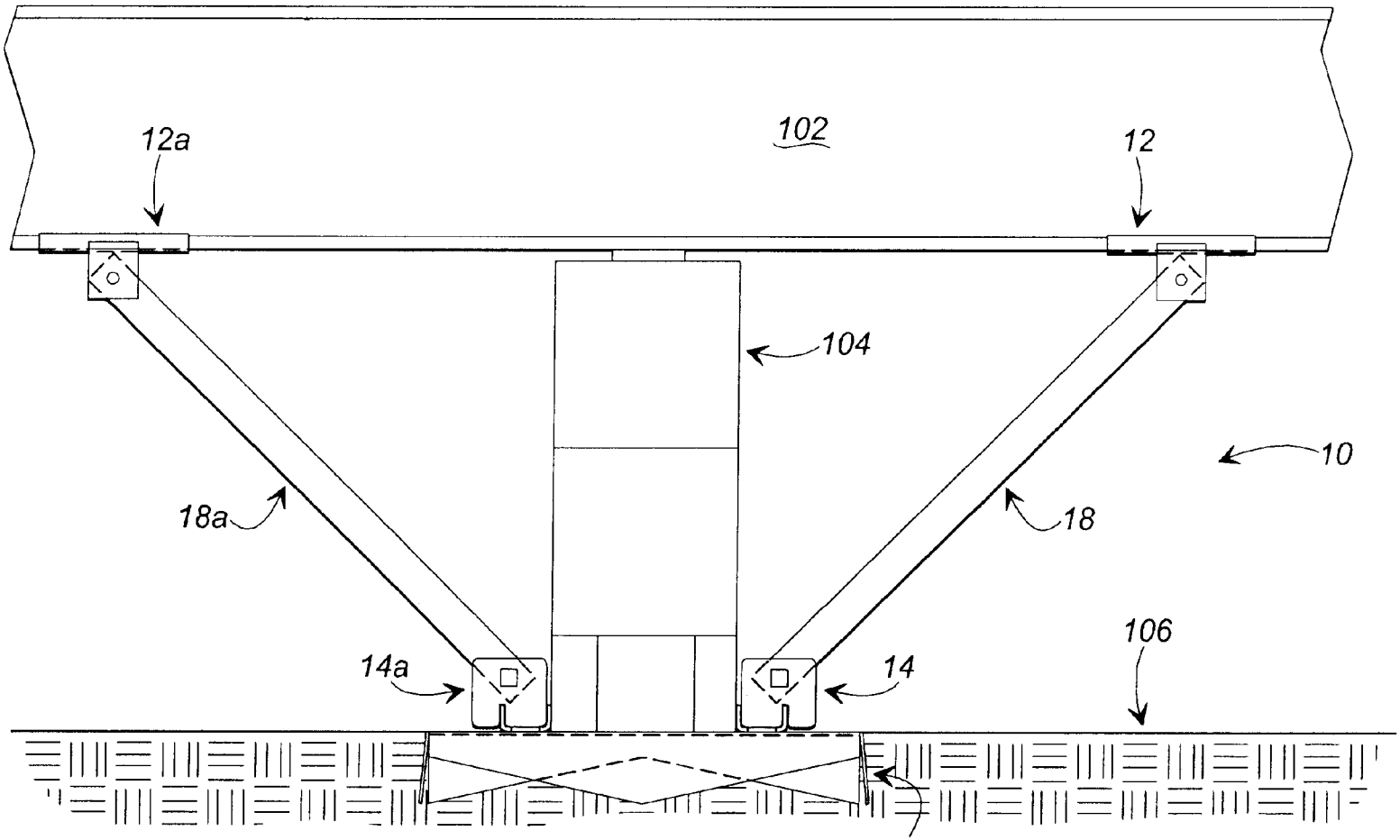
FIG. 1 is a side elevational view of the longitudinal stabilizing system.
Figure 2:
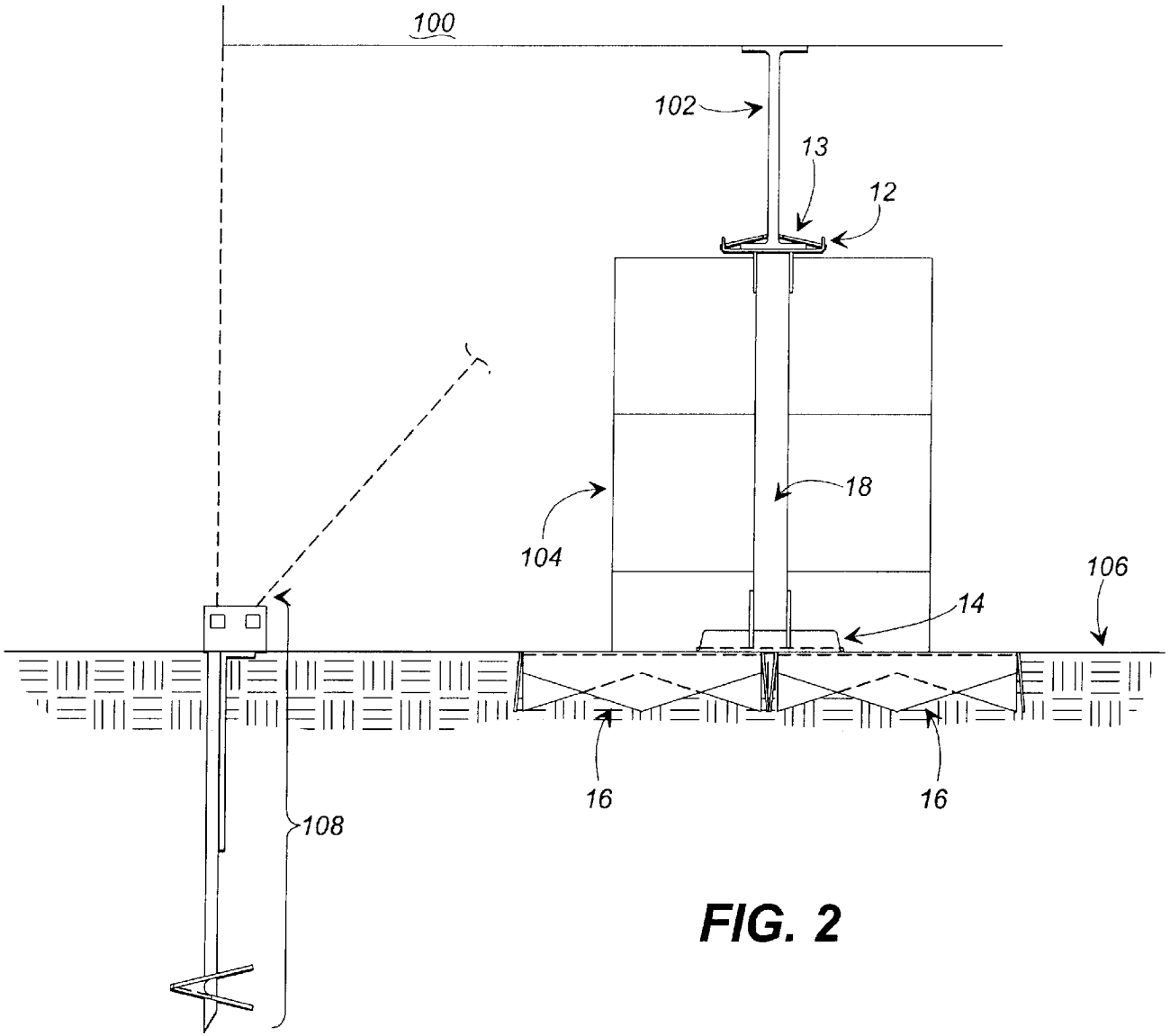
FIG. 2 is an end view of the Iongitudinal stabilizing system.
Figure 3:
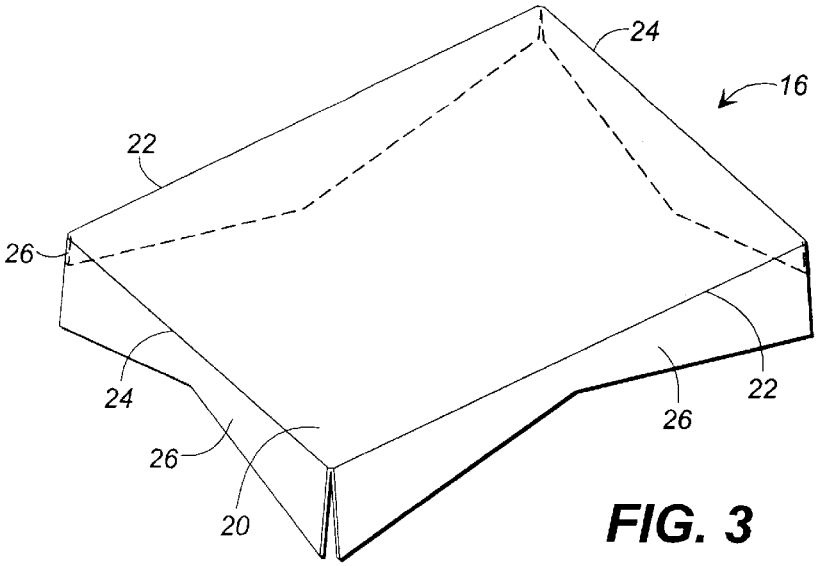
FIG. 3 is a perspective view of the foundation plate.
Figure 4:
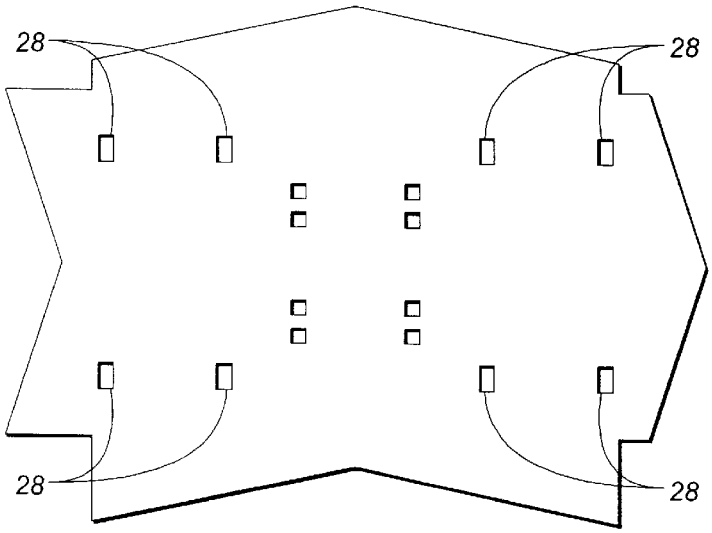
FIG. 4 is a top view of the foundation plate before its perimeter portions are folded to the positions illustrated in FIGS. 3, 5, and 6.
Figure 5:
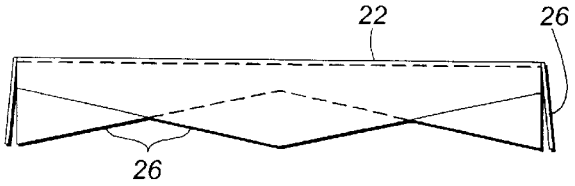
FIG. 5 is a side view of the foundation plate.
Figure 6:
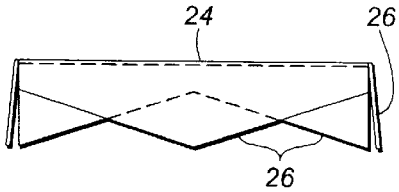
FIG. 6 is an end view of the foundation plate.

Referring now in more detail to the drawings in which like numerals indicate like parts throughout the several views, FIGS. 1–2 illustrate the preferred embodiment of the longitudinal stabilizing system 10 installed on a premanufactured building 100 having a support joist 102 on the underside of the building which extends the length of the building and is supported by an upright pier 104 above the ground 106. The longitudinal stabilizing system consists of at least one foundation pad 16, a joist connector 12, a plate connector 14, and a strut 18. The system may also be configured to utilize a second joist connector 12*a,* a second plate connector 14*a,* and a second strut 18*a* installed on the opposite side of the pier. As shown in FIG. 2, the system may be used in conjunction with a lateral stabilizing system 108.

Referring now to FIGS. 3–6, the foundation pad 16 has a planar top 20 with side edges 22 and end edges 24. A plurality of cleats 26 extends at an angle from the side and end edges in a common direction. The preferred embodiment would consist of four cleats, one on each side, but the invention may also have more or less than four cleats. The foundation pad may also contain a plurality of openings 28 on the planar surface. These openings allow for rigid connection of a plate connector 14 to the foundation pad by conventional fastening means (not shown). It would be apparent to one skilled in the art to provide another mechanism for rigid connection of the plate connector or to form the plate connector as part of the foundation pad.

The joist connector 12 is adapted to connect to the joist 102 as shown in FIGS. 1 and 2. Referring now to FIGS. 7–11, the joist connector includes a substantially U-shaped joist bracket 30 and a clevis 46. The bracket has ajoist bracket base 32 with opposed joist bracket side edges 34 and opposed joist bracket ends 36. A pair of joist bracket legs 38 extend from the joist bracket side edges in a common direction parallel to each other and substantially perpendicular to the joist bracket base. A pair ofjoist bracket openings 40, each having opposed joist bracket opening edges 42, are formed in the joist bracket. Each opening is located at the approximate center of a joist bracket leg extending through the joist bracket leg and the joist bracket base. The joist bracket base also has two pairs ofjoist bracket fastener holes 44. One of each pair ofjoist bracket fastener holes is located in between one of the joist bracket opening edges and the nearest one of the joist bracket ends. It would be obvious to one skilled in the art to construct the joist connector in other various forms without deviating from the spirit and scope of the invention.

The joist clevis 46 has a pair ofjoist clevis legs 48 that extend from the joist bracket base 32 in a common direction parallel to each other and in an opposite direction parallel to the joist bracket legs 38. The joist clevis legs are sized and shaped to correspond with the joist bracket openings 40. Each joist clevis leg has ajoist clevis fastener hole 50.

Figure 7:
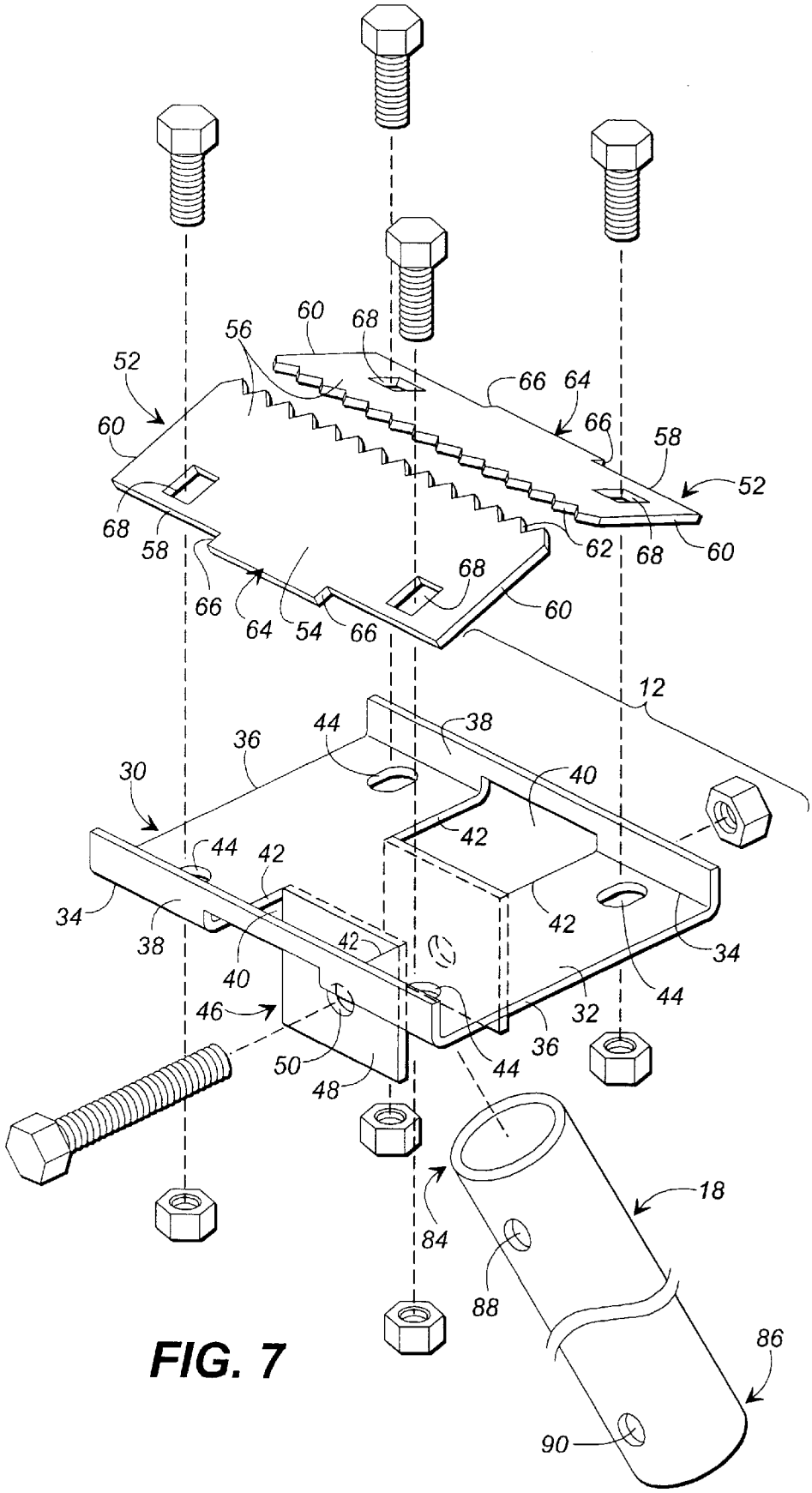
FIG. 7 is an exploded perspective view of the joist connector.
Figure 8:
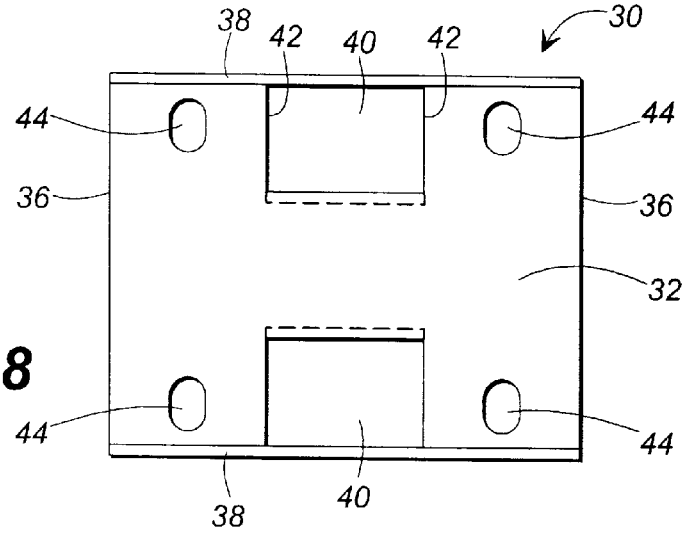
FIG. 8 is a top view of the joist connector.
Figure 9:
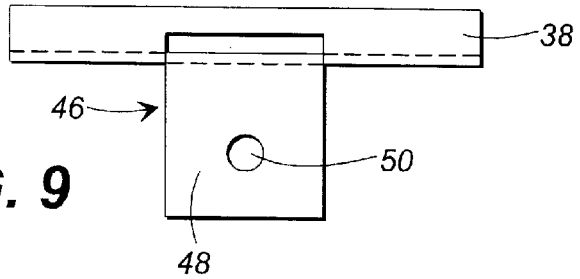
FIG. 9 is a side view of the joist connector.
Figure 10:
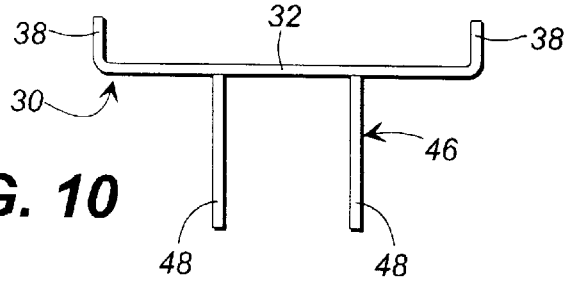
FIG. 10 is an end view of the joist connector.
Figure 11:
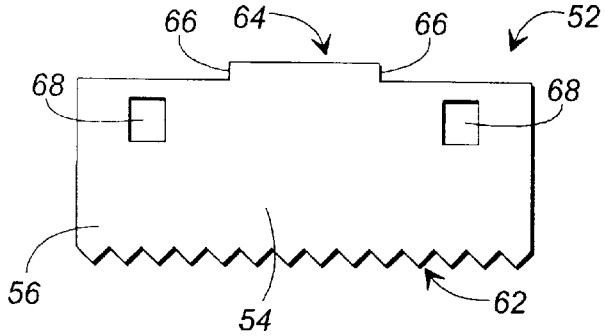
FIG. 11 is a top view of the clamp plate.

FIGS. 2 and 7 show a pair of clamp plates 52 that may be used in conjunction with the joist connector 12 to engage the joist 102 in order to inhibit movement of the joist with respect to the joist connector. Each clamp plate has a body portion 54, a first member edge 56, a second member edge 58, and opposed member ends 60. A plurality of teeth 62 are attached to the first member edge. A tab 64 is attached to the second member edge at the approximate center of the second member edge. The tab has opposed tab edges 66 and extends parallel to the body portion. The tab is sized and shaped to be insertable into one of the joist bracket openings 40. The body portion contains a pair of clamp plate fastener holes 68. One clamp plate fastener hole is located between one of the tab edges and the nearest one of the member ends such that the clamp plate fastener holes align with joist bracket fastener holes 44 when the tab is engaged with the joist bracket openings. It would be obvious to one skilled in the art to construct the plate clamp in other various configurations including different shapes, sizes, and engagement methods for engaging the bracket and grasping the joist. It would also be obvious to attach the plate clamp to the joist connector by other common attachment methods.

Referring now to FIGS. 12–15, the plate connector 14 includes a plate bracket 70 and a plate clevis 76. The plate bracket has a plate bracket base 72 with opposed plate bracket side edges 71 and opposed plate bracket ends 74. A pair of plate bracket sides 73 extend from the plate bracket side edges in a common direction parallel to each other and substantially perpendicular to the plate bracket base.

The plate clevis 76 includes a pair of plate clevis legs 78 extending from the plate bracket base 72 in a common direction parallel to each other and in a common direction perpendicular to the plate bracket sides 73. Each of the plate clevis legs includes a plate clevis fastener hole 80. The plate clevis legs may be wider than the plate clevis base and, in which case, would have a slot 79 sized, shaped, and located such that the slot will receive a plate bracket side therein.

The plate bracket 70 also contains a pair of plate bracket fastener holes 82. Each plate bracket fastener hole is located in the plate bracket base 72 between one of the plate clevis legs 78 and the nearest one of the plate bracket ends 74. The plate bracket fastener holes are located such that they align with the openings 28 of the foundation pad 16 for attachment thereto by conventional means.

It would be obvious to one skilled in the art to construct the plate connector 14 in other various configurations to achieve the same results. It would also be obvious to construct the plate connector such that it is attached to the foundation pad 16 by way of other common attachment methods, such as welding, or to form the plate connector as part of the foundation pad.

Figure 12:
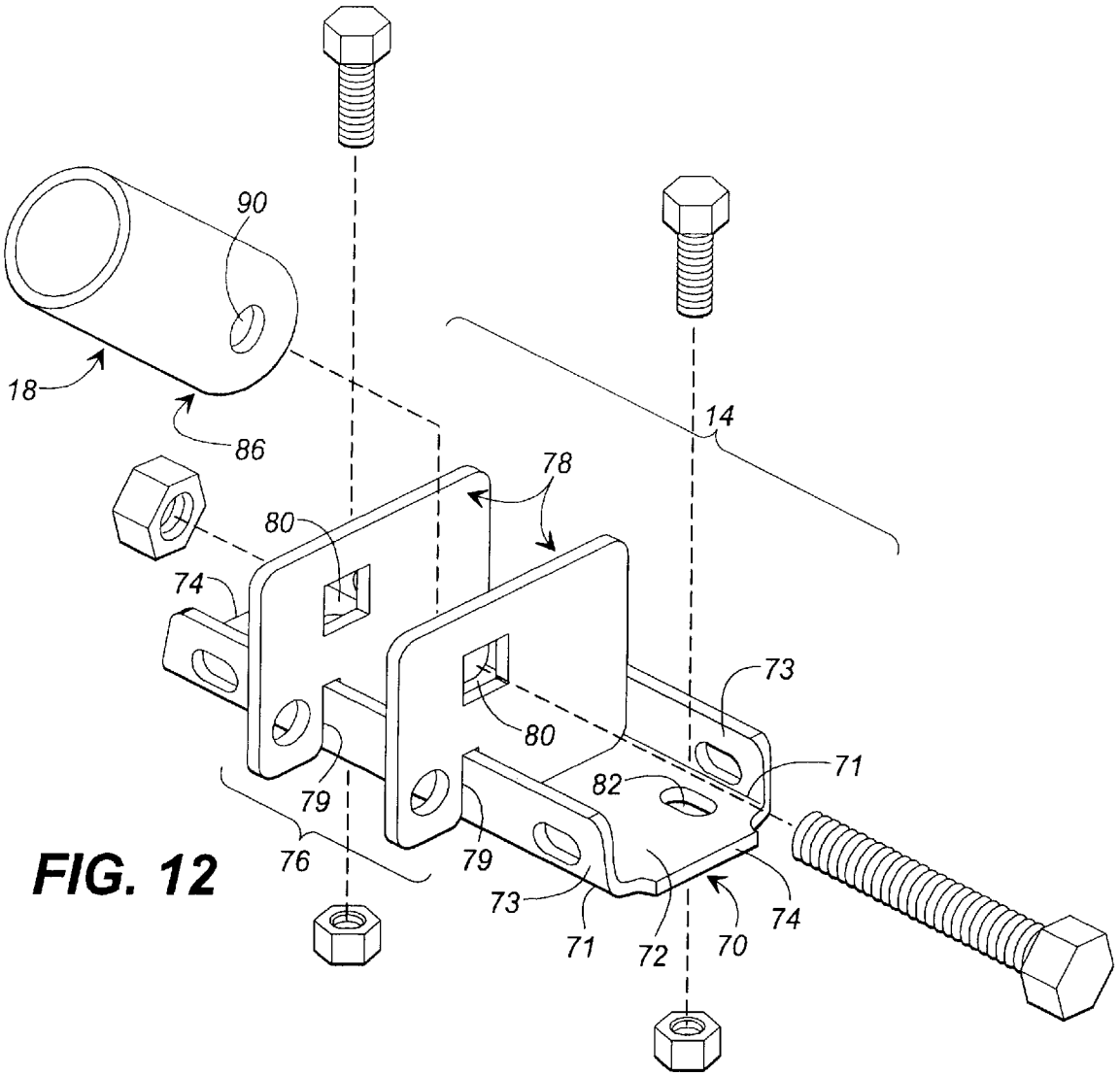
FIG. 12 is an exploded perspective view of the plate connector.
Figure 13:
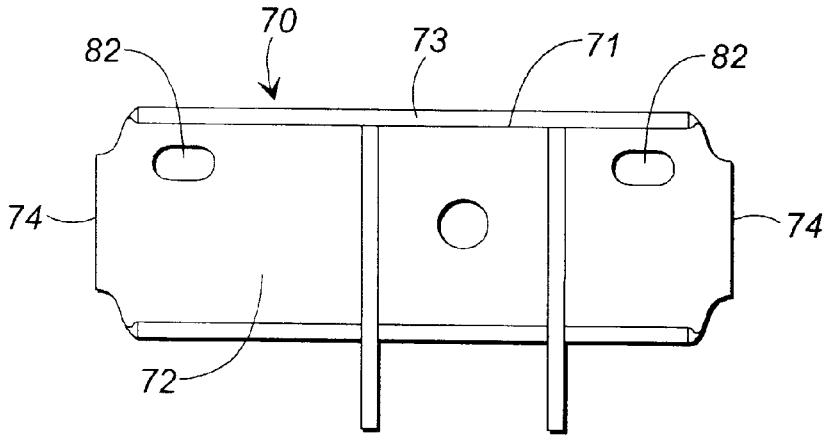
FIG. 13 is a top view of the plate connector.
Figure 14:
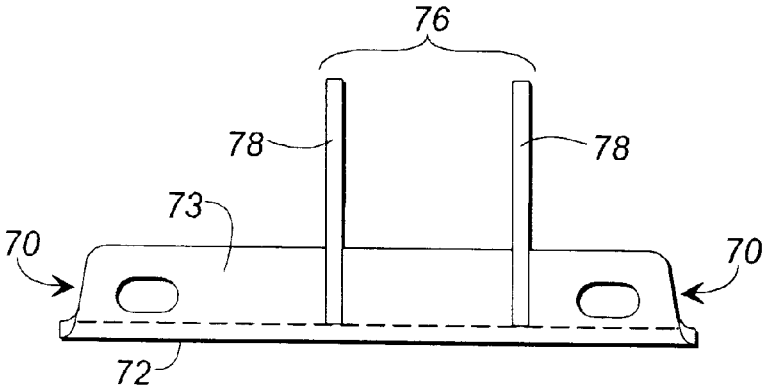
FIG. 14 is a side view of the plate connector.
Figure 15:
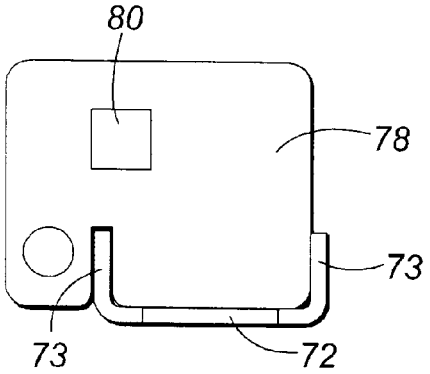
FIG. 15 is an end view of the plate connector.

The strut 18 is shown best in FIGS. 7 and 12. The strut is rectilinear with a strut first end 84 and a strut second end 86. The strut first end is sized and shaped to fit within the joist clevis 46. Strut joist fastener holes 88 are located in the strut first end to align with the joist clevis fastener holes 50 for connection thereto by conventional means. The strut second end is sized and shaped to fit within the plate clevis 76. Strut plate fastener holes 90 are located in the strut second end to align with the plate clevis fastener holes 80 for connection thereto by conventional means. The strut is installed in the longitudinal stabilizer system 10 such that the strut slopes downwardly from the joist 102 toward the foundation plate 16. In strong winds, the weight of the building 100 and the weight of the pier 104 resting on the foundation plate retard lateral movement of the foundation plate and the second end of the strut, while the first end of the strut resists movement of the joist along its length. It would be obvious to one skilled in the art to construct the strut in various forms to achieve the desired results.

It will be understood by those skilled in the art that while the foregoing description sets forth in detail preferred embodiments of the present invention, modifications, additions, and changes might be made thereto without departing from the spirit and scope of the invention, as set forth in the following claims.

I claim:

1. A stabilization system for a premanufactured building, the building including at least one elongated joist extending along the length of the building and with the joist supported on an upright support pier, said stabilization system comprising:

at least one foundation plate for positioning beneath a pier on which a joist of the building is supported;

a joist connector constructed and arranged for rigid connection to a joist of the building;

a plate connector constructed and arranged for rigid connection to said foundation plate; and a rectilinear strut having first and second opposed ends, said first end connected to said joist connector and said second end connected to said plate connector for sloping downwardly from said joist connector toward said foundation plate wherein said plate connector is not connected to the pier;

said foundation plate including a planar top wall having opposed surfaces, with one of said opposed surfaces for facing and bearing against the ground and the other of said opposed surfaces unobstructed for supporting piers of variable breadths and shapes adjacent said plate connector, and at least one cleat wall mounted to and extending at an angle with respect to said planar top and extending transversely to said strut for penetrating the ground beneath the foundation plate and resisting horizontal movement of the foundation plate in a direction normal to the length of the rectilinear strut;

whereby the weight of the building and the weight of the pier resting on said foundation plate and the cleat wall retard lateral movement of the foundation plate and the second end of said strut, so that the first end of the strut and the joist connector resist movement of the joist along its length.

2. The stabilization system of claim 1, wherein said strut is rigid.

3. The stabilization system of claim 1, wherein said joist connector comprises a pair of clamp plates for grasping the joist.

4. The stabilization system of claim 1, wherein:

said foundation plate top wall includes opposed plate side edges and opposed plate end edges;

said at least one cleat includes a plurality of cleats extending from said plate side edges and said plate end edges; and a plurality of plate fastener holes located in said foundation plate top for rigid connection of said plate connector to said foundation plate.

5. A stabilization system for a premanufactured building, the building including at least one elongated joist extending along the length of the building and with the joist supported on an upright support pier, said stabilization system comprising:

at least one foundation plate for positioning beneath a pier on which a joist of the building is supported so that the foundation plate is at a level lower than the joist and the weight of the pier and the building will rest on said foundation plate;

a joist connector constructed and arranged for rigid connection to a joist of the building resting on the upright support pier of the building;

a plate connector connected to said foundation plate;

a rectilinear strut having first and second opposed ends, said first end connected to said joist connector and said second end connected to said plate connector, with said strut sloped downwardly from the joist connector toward said foundation plate;

said joist connector comprising;

a substantially U-shaped bracket including a base with opposed side edges, opposed ends, a pair of legs extending from said opposed side edges in a common direction parallel to each other and substantially perpendicular to said base, a pair of openings, each of said openings having opposed opening edges formed in said bracket at the approximate center of one of said legs extending through said leg and said base, two pairs of fastener holes, one of each pair of said fastener holes located in said base between one of said opening edges and the nearest one of said opposed ends; and a clevis including a pair of clevis legs sized and shaped to correspond with said openings extending from said base of said bracket in a common direction parallel to each other and in an opposite direction parallel to said legs of said bracket, and each of said clevis legs including a clevis fastener hole;

whereby the weight of the building and the weight of the prier resting on said foundation plate retard lateral movement of the foundation plate and the plate connector, strut, and joist connector resist movement of the joist along its length.

6. The stabilization system of claim 5, wherein said joist connector further comprises a pair of clamp plates for grasping the joist including:

a body portion;

first and second member edges;

opposed member ends;

a plurality of teeth attached to said first member edge;

a tab having opposed tab edges, said tab attached to said second member edge at the approximate center of said second member edge, extending parallel to said body portion, and sized and shaped to be insertable into one of said openings of said joist connector; and a pair of fastener holes, each of said fastener holes located in said body portion between one of said tab edges and the nearest one of said member ends such that said fastener holes align with said fastener holes of said joist connector when said tab is engaged with said openings of said joist connector.

7. The stabilization system of claim 1, wherein said plate connector comprises:

a bracket with a base, opposed side edges, opposed ends, and opposed sides extending from said side edges in a common direction parallel to each other and substantially perpendicular to the plate bracket base; and a clevis including a pair of clevis legs extending from said base in a common direction parallel to each other and perpendicular to said base, each of said clevis legs including a clevis fastener hole, and a pair of bracket fastener holes, each of said bracket fastener holes located in said base between one of said clevis legs and the nearest one of said ends.

8. The stabilization system of claim 7, wherein said clevis legs are wider than said base, each of said clevis legs containing a slot sized, shaped, and located to receive one of said sides therein.

9. A stabilization system for a premanufactured building, the building including at least one elongated joist extending along the length of the building and with upright support piers on the ground supporting the joist, said stabilization system comprising:

at least one foundation plate for positioning between a pier supporting the joist and the ground, said foundation plate having a planar top for supporting the weight of the pier and the building resting on said foundation plate;

a joist connector constructed and arranged for rigid connection to a joist of the building;

a plate connector constructed and arranged for rigid connection to said foundation plate; and a rectilinear strut having first and second opposed ends, said first end connected to said joist connector and said second end connected to said plate connector, with said strut sloped downwardly from the joist toward said foundation plate;

at least one cleat extending normal to said planar top, said cleat being shaped as a planar surface extending transverse to the length of said rectilinear strut for opposing movement of said rectilinear strut along its length:

whereby the weight of the building and the weight of the pier resting on said foundation plate and the cleat engagement with the ground retard lateral movement of the foundation plate and the second end of said strut, and the first end of the strut and the joist connector resist movement of the joist along its length.

10. The stabilization system of claim 9, wherein said strut is rigid.

11. The stabilization system of claim 9, wherein said joist connector includes a pair of clamp plates for grasping the joist.

12. A stabilization system for mounting between an I-beam joist of a premanufactured building and a pier supporting the I-beam joist comprising:

a foundation plate for positioning on the surface of the ground beneath a pier on which ajoist of the building is supported and for bearing the weight of the pier and the building;

a joist connector constructed and arranged for rigid connection to the I-beam joist supported by the pier;

a rectilinear strut having opposed ends, one end of said strut connected to said foundation plate and the other end of said strut connected to said joist connector;

said foundation plate including a top for supporting the pier and at least one cleat extending from said top and extending as a wall across the breadth of said top transverse to the length of said strut to form a cleat wall for penetrating the ground beneath the foundation plate;

whereby the foundation plate bears the weight of the pier and building and the cleat is held in the ground by the weight applied by the pier and building to the foundation plate and resists horizontal movement of the foundation plate, strut, joist connector and I-beam.

13. The stabilization system of claim 12, wherein said top includes opposed side edges, and said cleats extend from said opposed side edges.

14. The stabilization system of claim 12, and wherein said top of said foundation plate and said cleat are characterized by having been formed from a single piece of sheet material, with said cleat bent at an angle with respect to said top.

15. The stabilization system of claim 14 wherein said top of the foundation plate is rectangular with opposed side edges and opposed end edges and said cleat comprises cleats extending along and from all of said opposed edges.

16. The stabilizer of claim 14 and where said cleats extend along and from said opposed end edges.

17. The stabilizer of claim 12 and wherein said at least one cleat comprises cleats oriented at right angles with respect to each other.

* * * * *